US006196533B1

(12) United States Patent
Hudson

(10) Patent No.: US 6,196,533 B1
(45) Date of Patent: Mar. 6, 2001

(54) SHEET MATERIAL WORK BENCH

(76) Inventor: Dennis M. Hudson, #101-550 Royal Avenue, New Westminster, BC V3L 5H9 (CA)

( * ) Notice: Subject to any disclaimer, the term of this patent is extended or adjusted under 35 U.S.C. 154(b) by 0 days.

(21) Appl. No.: 09/494,166

(22) Filed: Jan. 31, 2000

(51) Int. Cl.[7] ..... B25B 11/00
(52) U.S. Cl. ..... 269/21; 269/329
(58) Field of Search ..... 269/21, 20, 329; 279/3; 294/64.1; 451/388

(56) References Cited

U.S. PATENT DOCUMENTS

| | | | | |
|---|---|---|---|---|
| D. 304,112 | | 10/1989 | Bettess . | |
| 477,306 | * | 6/1892 | Marsh | 269/21 |
| 2,969,299 | * | 1/1961 | Fullerton | 269/21 |
| 3,156,462 | * | 11/1964 | Weaver | 269/21 |
| 3,180,608 | | 4/1965 | Fischer . | |
| 3,598,006 | | 8/1971 | Gerber . | |
| 4,468,017 | * | 8/1984 | Pavone | 269/21 |
| 4,561,642 | | 12/1985 | Parque . | |
| 4,768,763 | * | 9/1988 | Gerber | 269/21 |
| 4,871,154 | | 10/1989 | Seney . | |
| 5,572,786 | | 11/1996 | Rensch . | |
| 6,095,506 | * | 8/2000 | Schmalz | 269/21 |

* cited by examiner

*Primary Examiner*—David A. Scherbel
*Assistant Examiner*—Daniel Shanley

(57) ABSTRACT

A sheet material work bench for holding sheet material without the need of clamps. The sheet material work bench includes a support portion. The support portion comprises a central column. The column is generally hollow. A table portion comprises a plate having a top side, a bottom side and a peripheral edge. A plurality of bores are located in the plate. Each of the bores is generally adjacent to a central location of the table portion. A coupling means couples the table portion to the support portion. A suction means draws air through the bores. The suction means is mounted in the support portion and draws air into the support portion through the bores.

10 Claims, 3 Drawing Sheets

FIG. 3
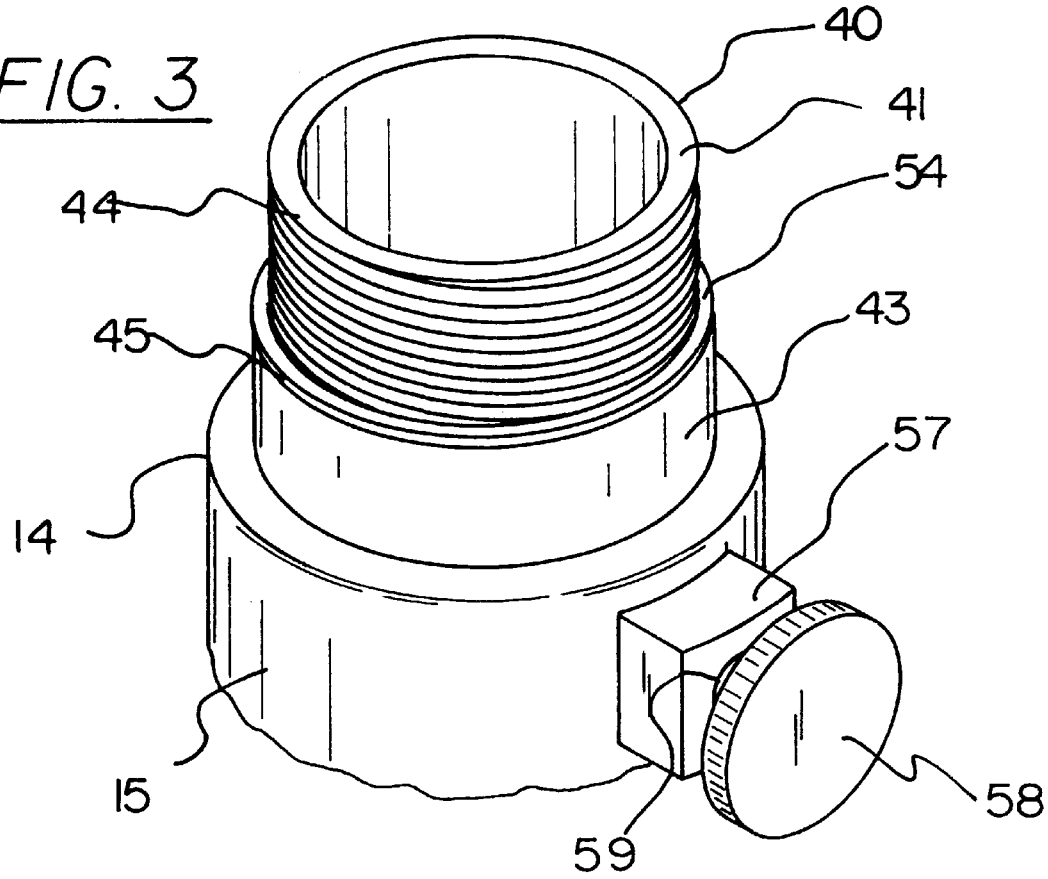
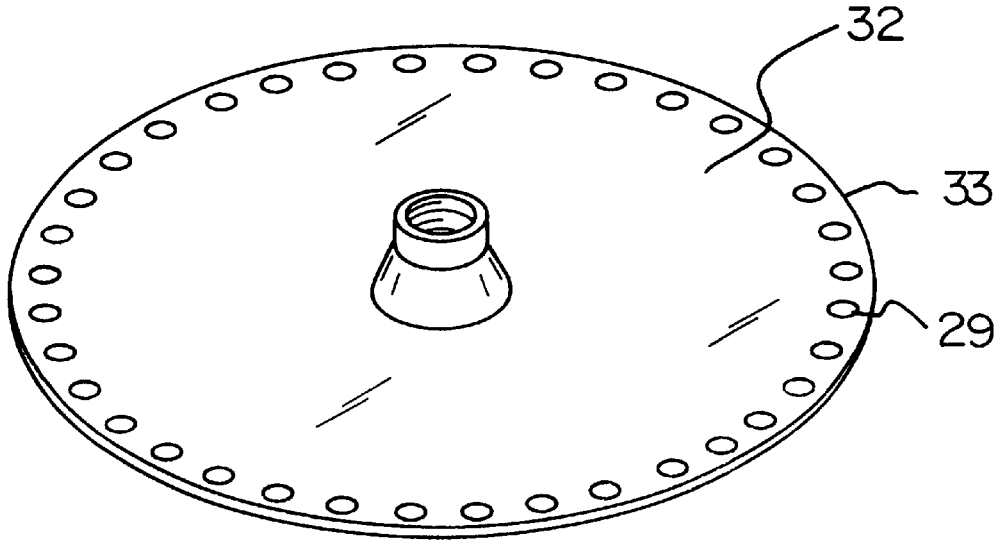
FIG. 4

SHEET MATERIAL WORK BENCH

BACKGROUND OF THE INVENTION

1. Field of the Invention

The present invention relates to work benches and more particularly pertains to a new sheet material work bench for holding sheet material without the need of clamps.

2. Description of the Prior Art

The use of work benches is known in the prior art. More specifically, work benches heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,561,642; U.S. Pat. No. 5,572,786; U.S. Pat. No. 3,598,006; U.S. Pat. No. 4,871,154; U.S. Pat. No. 3,180,608; and U.S. Des. Pat. No. 304.112.

While these devices fulfill their respective, particular objectives and requirements, the aforementioned patents do not disclose a new sheet material work bench. The inventive device includes a support portion. The support portion comprises a central column. The column is generally hollow. A table portion comprises a plate having a top side, a bottom side and a peripheral edge. A plurality of bores are located in the plate. Each of the bores is generally adjacent to a central location of the table portion. A coupling means couples the table portion to the support portion. A suction means draws air through the bores. The suction means is mounted in the support portion and draws air into the support portion through the bores.

In these respects, the sheet material work bench according to the present invention substantially departs from the conventional concepts and designs of the prior art, and in so doing provides an apparatus primarily developed for the purpose of holding sheet material without the need of clamps.

SUMMARY OF THE INVENTION

In view of the foregoing disadvantages inherent in the known types of work benches now present in the prior art, the present invention provides a new sheet material work bench construction wherein the same can be utilized for holding sheet material without the need of clamps.

The general purpose of the present invention, which will be described subsequently in greater detail, is to provide a new sheet material work bench apparatus and method which has many of the advantages of the work benches mentioned heretofore and many novel features that result in a new sheet material work bench which is not anticipated, rendered obvious, suggested, or even implied by any of the prior art work benches, either alone or in any combination thereof.

To attain this, the present invention generally comprises a support portion. The support portion comprises a central column. The column is generally hollow. A table portion comprises a plate having a top side, a bottom side and a peripheral edge. A plurality of bores are located in the plate. Each of the bores is generally adjacent to a central location of the table portion. A coupling means couples the table portion to the support portion. A suction means draws air through the bores. The suction means is mounted in the support portion and draws air into the support portion through the bores.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new sheet material work bench apparatus and method which has many of the advantages of the work benches mentioned heretofore and many novel features that result in a new sheet material work bench which is not anticipated, rendered obvious, suggested, or even implied by any of the prior art work benches, either alone or in any combination thereof.

It is another object of the present invention to provide a new sheet material work bench which may be easily and efficiently manufactured and marketed.

It is a further object of the present invention to provide a new sheet material work bench which is of a durable and reliable construction.

An even further object of the present invention is to provide a new sheet material work bench which is susceptible of a low cost of manufacture with regard to both materials and labor, and which accordingly is then susceptible of low prices of sale to the consuming public, thereby making such sheet material work bench economically available to the buying public.

Still yet another object of the present invention is to provide a new sheet material work bench which provides in the apparatuses and methods of the prior art some of the advantages thereof, while simultaneously overcoming some of the disadvantages normally associated therewith.

Still another object of the present invention is to provide a new sheet material work bench for holding sheet material without the need of clamps.

Yet another object of the present invention is to provide a new sheet material work bench which includes a support portion. The support portion comprises a central column.

The column is generally hollow. A table portion comprises a plate having a top side, a bottom side and a peripheral edge. A plurality of bores are located in the plate. Each of the bores is generally adjacent to a central location of the table portion. A coupling means couples the table portion to the support portion. A suction means draws air through the bores. The suction means is mounted in the support portion and draws air into the support portion through the bores.

Still yet another object of the present invention is to provide a new sheet material work bench that uses suction to hold a portion of sheet material against a work bench and thus leaves the surface of the sheet material free of clamps.

Even still another object of the present invention is to provide a new sheet material work bench that is height adjustable to aid the user in reaching the sheet material.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a schematic perspective of the male portion of the coupling means view of the present invention.

FIG. 4 is a schematic perspective view of the bottom surface of the table portion of the present invention.

DESCRIPTION OF THE PREFERRED EMBODIMENT

Figure 1:
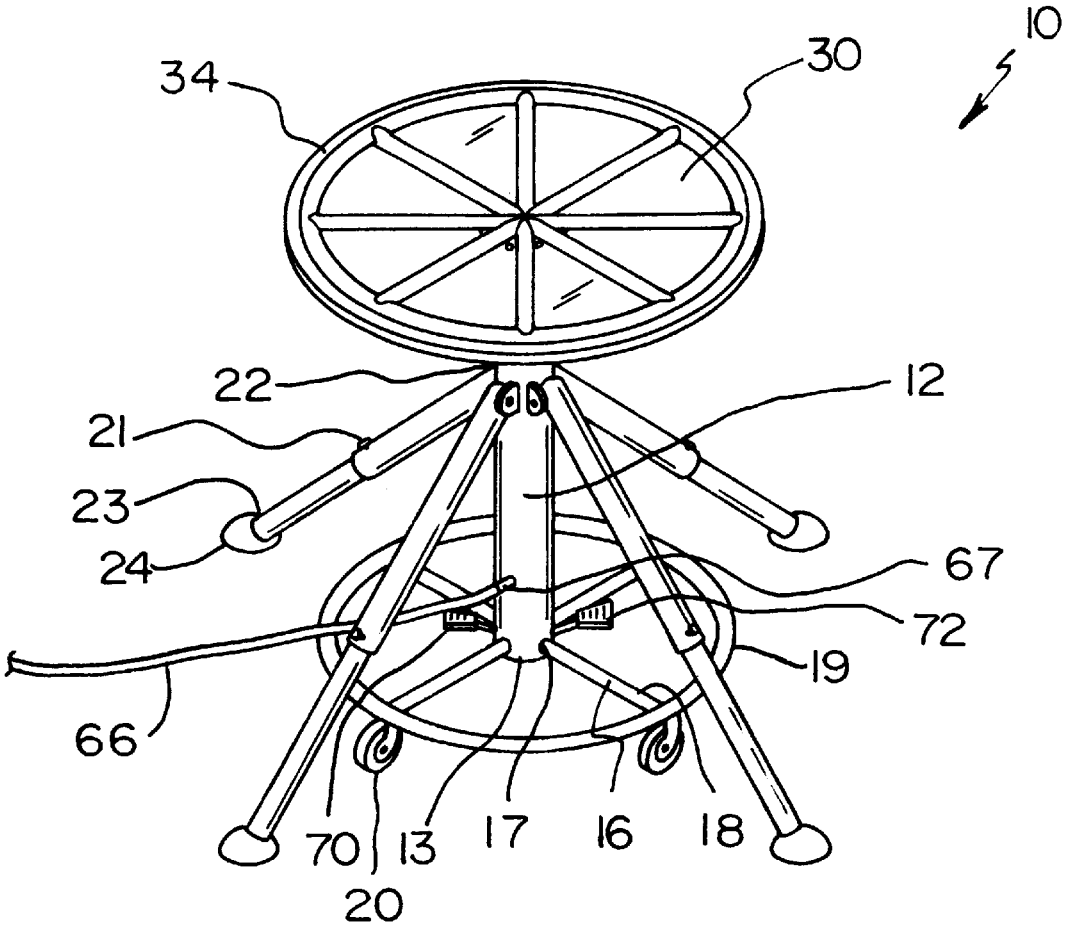
FIG. 1 is a schematic perspective view of a new sheet material work bench according to the present invention.

With reference now to the drawings, and in particular to FIGS. 1 through 7 thereof, a new sheet material work bench embodying the principles and concepts of the present invention and generally designated by the reference numeral 10 will be described.

As best illustrated in FIGS. 1 through 7, the sheet material work bench 10 generally comprises a support portion, a table portion, a coupling means and suctions means.

The supporting means has an upstanding member 12. The upstanding member 12 has a bottom end 13, a top end 14, and a peripheral wall 15 extending between the top 14 and bottom 13 ends. The top end 14 is open. The upstanding member 12 has a generally circular shaped cross-section taken transverse to a longitudinal axis of the upstanding member, and the upstanding member is hollow. The upstanding member is a post.

A base assembly supports the upstanding member. The base assembly comprises four arms 16. Each of the arms has a first end 17 and a second end 18. Each of the first ends 17 is fixedly coupled to the peripheral wall 15. The first ends 17 are located generally adjacent to the bottom end 13 of the upstanding member. Each of the arms 16 radially extends away from the upstanding member 12. Each of the arms 16 is spaced an equal distance from each other. The arms 16are oriented generally perpendicular to the longitudinal axis of the upstanding member 12.

A brace 19 braces the arms 16 of the base assembly. The brace 19 forms a hoop. The hoop has an interior surface. Each of the second ends 18 of the arms 16 is integrally coupled to the interior surface of the hoop.

A plurality of wheels 20 is rotatably coupled to the brace 19. Each of the wheels 20 is located generally adjacent to a juncture of one of the arms 16 and the brace 19. Each of the wheels 20 extends away from the top end 14 of the upstanding member 12.

A plurality of supporting means help support the upstanding member. Each of the supporting means is a leg 21 having a first 22 end and a second end 23. Each of the first ends 22 of the legs 21 is pivotally coupled to the peripheral wall 15 of the upstanding member 12. The first ends 22 of the legs 21 are generally adjacent to the top end 14 of the upstanding member 12. Each of the second ends 23 of the legs 21 has a foot 24 thereon. The feet 24 comprise an elastomeric material. The legs 21 are telescopic and a length of each may be selectively adjusted.

The table portion comprises a plate 30. The plate 30 has a top side 31, a bottom side 32 and a peripheral edge 33. The bottom side 32 has depressions 29 therein to facilitate turning the table portion. The depressions 29 are located generally adjacent to the peripheral edge 33. The plate 30 has a generally circular shape.

An annular lip 34 is fixedly coupled to the top side 31 of the plate 30. The annular lip 34 is generally adjacent to the peripheral edge 33 of the plate 30. The annular lip 34 has a generally rectangular shaped cross section and has an inside wall.

A plurality of elongate members 35 for supporting the sheet material above the plate 30 has a first end 36 and a second end 37. Each of the first ends 36 of the elongate members 35 is fixedly coupled at a central location of the table portion. Each of the elongate members 35 radially extends away from a central portion of the plate 30. The second ends 37 of the elongate members 35 are integrally coupled to the inside wall of the annular lip 34. Each of the elongate members 35 is abutted against the plate 30, and each has a height generally equal to a height of the annular lip 34. The elongate members 35 and the annular lip 34 are covered with an elastomeric material. The plurality of elongate members ideally comprises eight elongate members 35. A seal 38 is placed at the juncture of the first ends of the elongate members 35.

A plurality of bores 39 is in the plate 30. Each of the bores 39 is generally adjacent to the central location of the table portion.

Figure 2:
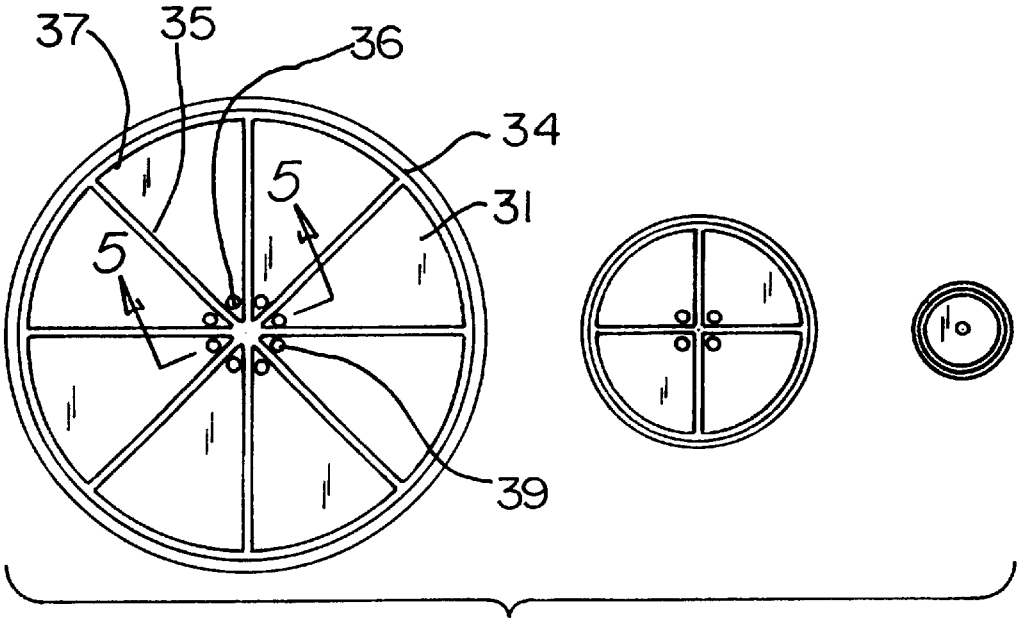
FIG. 2 is a schematic plan view of the table portions of the present invention.
Figure 5:
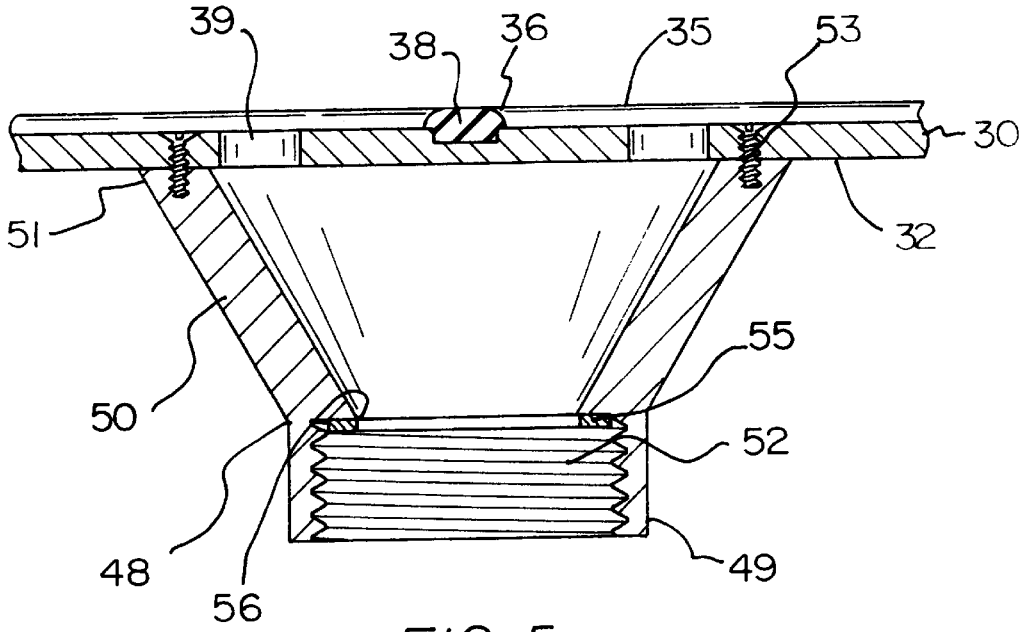
FIG. 5 is a schematic cross-sectional view of the female portion of the coupling means of the present invention.
Figure 6:
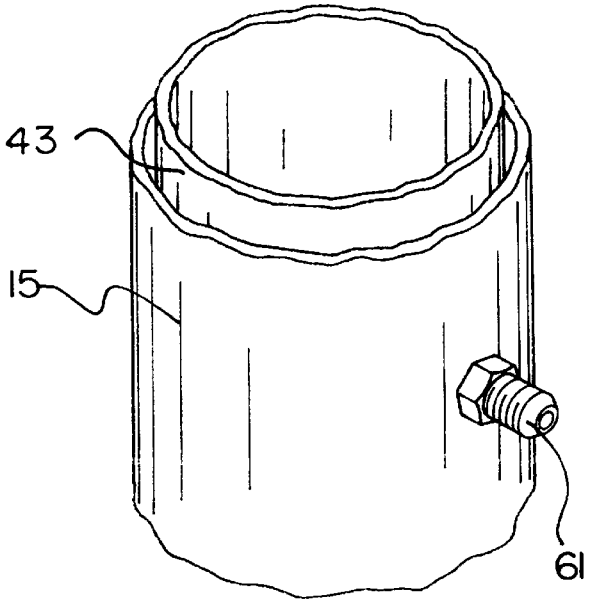
FIG. 6 is a schematic perspective view of the present invention.
Figure 7:
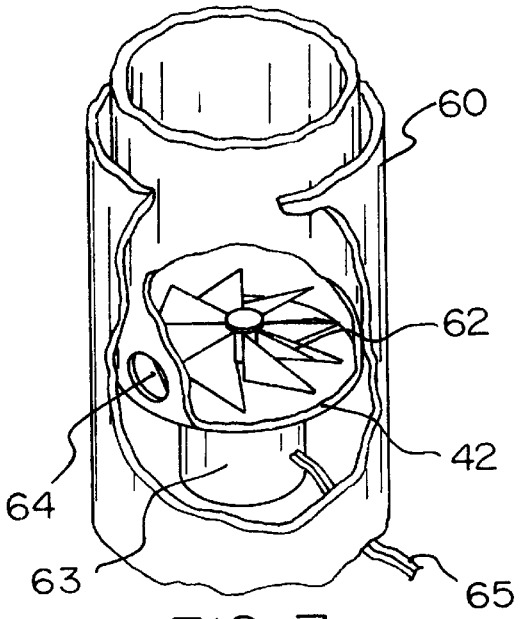
FIG. 7 is a schematic perspective view of the suction means of the present invention.

The table portion may come in various sizes and, therefor, have a differing number of elongate members or none at all. FIG. 2 illustrates different embodiment of the table portion. Ideally, the table portions have a diameter between thirty inches and five inches.

The coupling means couples the table portion to the top end 14 of the upstanding member 12. The coupling means comprises a male portion 40 and a female portion 48. The male portion 40 is elongate having a first end 41, a second end 42 and a peripheral wall 43. The peripheral wall 43 has an exterior surface. The male portion is generally a rod having a shape adapted to fit in the upstanding member 12. The rod is generally hollow and is rotatably insertable in the upstanding member 12. The peripheral wall 43 of the male portion has threads 44 thereon. The threads 44 are generally adjacent to the first end 41 of the male portion 40. The second end 42 of the male portion 40 is insertable in the upstanding member 12. The male portion 40 has a generally circular cross-section. The peripheral wall 43 has an annular shoulder formed 45 therein. The annular shoulder 45 is adjacent to an edge of the threads 44 between the threads 44 and the second end of the male portion 40. The male member 40 is adapted to extend away from the upstanding member 12, and, ideally, the male portion 40 forms a telescoping arm.

The female portion 48 has a distal portion 49, a proximal portion 50 and a peripheral edge 51 is adjacent to the proximal portion 50. The female portion 48 is generally hollow. The distal portion 49 has an inner surface having threads 52 thereon. The distal portion 49 has a shape adapted for receiving the first end 41 of the male portion 40. A fastening means 53 releasably secures the peripheral edge 51 of the female portion 48 to the bottom surface 32 of the plate 30. The female portion 48 is located generally in the central portion of the plate 30. The fastening means 53 is a screw. The proximal portion 50 generally has a frusto-conical shape.

A first seal 54 fluidly connects the male 40 and female 48 portions. The first seal 54 is an annular member and is abutted against the annular shoulder 45 of the male portion 40. The first seal 54 is made from an elastomeric material. Ideally, the first seal 54 is an O-ring.

A second seal 55 fluidly connects the male 40 and female 48 portions. The second seal 55 is an annular member and is abutted against an annular shoulder 56 formed by a juncture of the distal 49 and proximal 50 portions of the female portion 48. The second seal 55 is made from an elastomeric material. Ideally, the second seal is an O-ring.

A securing means 57 selectively secures a position of the coupling means with respect to the upstanding member 12. The securing means has a knob portion 58 and a rod portion 59. The rod portion 59 has threads thereon, not shown. The rod portion 59 is inserted through a bore in the upstanding member 12. The bore is generally adjacent to the top end 14 of the upstanding member 12. The rod portion 59 is selectively abuttable against the exterior surface 43 of the male portion 40.

The suction means 60 draws air through the bores 39 in the plate 30. The suction means 60 comprises an aperture, not shown, in the peripheral wall 15 of the upstanding member 12. The aperture is located generally adjacent to the bottom end 13 of the upstanding member 12. The aperture has a stem 61 fluidly connected thereto. The stem 61 extends away from the upstanding member 12 and is hollow.

A fan propeller 62 actuates air flow in a direction from the bores 39 in the plate 12 and through the aperture in the peripheral wall 15 of the upstanding member 12.

A motor rotates 63 the fan propeller 62. The motor 63 is mounted to the second end of the male portion. The fan propeller 62 is rotatably coupled to the motor 63. A bore 64 is in the peripheral wall 43 of the male portion 40 generally adjacent to the fan propeller 62.

A power supply 65 is operationally coupled to the motor.

A hose 66 draws air from the upstanding member 12. The hose 66 has a first end 67 and a second end, not shown. The first end 67 of the hose 66 is removably coupled to the stem 61. The second end of the hose 66 may be fluidly coupled to an air pump in lieu of using the motor 63.

A release valve is mechanically coupled to the aperture in the peripheral wall 15 of the upstanding member 12. A lever 70 actuates the release valve. The lever 70 is mounted on the peripheral wall and the lever is located generally adjacent to the bottom end of the upstanding member. Ideally, the lever 70 is a foot pedal.

An actuating means 72 selectively raises the male portion 40 of the coupling means with respect to the upstanding member 12. The actuating means comprises a jack, not shown, mounted in the upstanding member 12. The jack is preferably a pneumatic pump, although a hydraulic pump or a mechanical lift may be used. A lever for engaging the jack is mounted in the peripheral wall 15 of the upstanding member 12. The lever is located generally adjacent to the bottom end 13 of the upstanding member 12. Ideally, the lever is a foot pedal.

In use, a portion of sheet metal or other rigid and generally planar material is placed on the elongate members 35 of the plate 30. The air is drawn out of the area between the sheet metal and the plate 30. The sheet metal is held in place by the suction created and the user may work on all areas of the sheet metal without the need to remove or adjust clamps.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation assembly and use, are deemed readily apparent and obvious to one skilled in the art, and all equivalent relationships to those illustrated in the drawings and described in the specification are intended to bc encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A sheet material work bench apparatus, said apparatus comprising:

a support portion, said support portion comprising a central column, said column being generally hollow;

a table portion, said table portion comprising;

a plate, said plate having a top side, a bottom side and a peripheral edge;

a plurality of bores in said plate, each of said bores being generally adjacent to a central location of said table portion;

a coupling means coupling said table portion to said support portion; and a suction means for drawing air through said bores, said suction means being mounted in said support portion, said suction means drawing air into said support portion through said bores.

2. The sheet material work bench apparatus as in claim 1, said support portion further comprising:

an upstanding member, said upstanding member having a bottom end, a top end, and a peripheral wall extending between said top and bottom ends, said top end being open, said upstanding member being hollow;

a base assembly for supporting said upstanding member, said base assembly comprising a plurality of arm, each of said arms having a first end and a second end, each of said first ends being fixedly coupled to said peripheral wall, said first ends being located generally adjacent to said bottom end of said upstanding member, each of said arms radially extending away from said upstanding member;

a brace for bracing said arms of said base assembly, said brace forming a hoop, said hoop having an interior surface, each of said second ends of said arms being integrally coupled to said interior surface of said hoop; and a plurality of wheels, each of said wheels being rotatably coupled to said brace.

3. The sheet material work bench apparatus as in claim 2, wherein said support portion further comprises:

a plurality of supporting means, each of said supporting means being a leg having a first end and a second end, each of said first ends of said legs being pivotally coupled to said peripheral wall of said upstanding member, each of said first ends of said legs being generally adjacent to said top end of said upstanding member, each of said legs being telescopic, wherein a length of each of said legs may be selectively adjusted.

4. The sheet material work bench apparatus as in claim 2, wherein said table portion further comprises:

said plate having a top side a bottom side and a peripheral edge;

an annular lip, said annular lip being fixedly coupled to said top side of said plate, said annular lip being generally adjacent to said peripheral edge of said plate; and a plurality of elongate members for supporting the sheet material above said plate, each of the elongate members having a first end and a second end, each of said first ends of said elongate members being fixedly coupled at a central location of said table portion, each of said elongate members radially extending away from a central portion of said plate, each of said second ends of said elongate members being integrally coupled to said annular lip.

5. The sheet material work bench apparatus as in claim 4, wherein said coupling means further comprises:

a male portion, said male portion being elongate, said male portion having a first end, a second end and a peripheral wall, said peripheral wall having an exterior surface, said male portion being a rod, said rod having a shape adapted to fit in said upstanding member, said rod being generally hollow, said rod being rotatably insertable in said upstanding member, said peripheral wall of said male portion having threads thereon, said threads being generally adjacent to said first end of said male portion; and a female portion, said female portion having a distal portion and a proximal portion, said female portion having a peripheral edge being adjacent to said proximal portion, said female portion being generally hollow, said distal portion having an inner surface having threads thereon, said distal portion having a shape adapted for receiving said first end of said male portion, a fastening means releasably securing said peripheral edge of said female portion to said bottom surface of said plate.

6. The sheet material work bench apparatus as in claim 5, wherein said coupling means further comprises:

a first seal for fluidly connecting said male and female portions, said first seal being an annular member, said first seal being abutted against an annular shoulder of said male portion; and a second seal for fluidly connecting said male and female portions, said second seal being an annular member, said second seal being abutted against an annular shoulder formed by a juncture of said distal and proximal portions of said female portion.

7. The sheet material work bench apparatus as in claim 6, wherein said coupling means further comprises:

a securing means for selectively securing a position of said coupling means with respect to said upstanding member, said securing means having a knob portion and a rod portion, said rod portion having threads thereon, said rod portion being inserted through a bore in said upstanding member, said bore being generally adjacent to said top end of said upstanding member, said rod being selectively abuttable against said exterior surface of said male portion.

8. The sheet material work bench apparatus as in claim 2, wherein suction means further comprises:

an aperture in said peripheral wall of said upstanding member, said aperture being located generally adjacent to said bottom end of said upstanding member, said aperture having a stem fluidly connected thereto, said stem extending away from said upstanding member, said stem being hollow;

a fan propeller to actuate air flow in a direction from said bores in said plate and through said aperture in said peripheral wall of said upstanding member;

a motor for rotating said fan propeller, said motor being mounted to said second end of said male portion, said fan propeller being rotatably coupled to said motor, a bore being in said peripheral wall of said male portion generally adjacent to said fan propeller; and a power supply, said power supply being operationally coupled to said motor.

9. The sheet material work bench apparatus as in claim 8, wherein said suction means further comprises:

a hose for drawing air from said upstanding member, said hose having a first end and a second end, said first end of said hose being removably coupled to said stem, wherein said second end of said hose may be fluidly coupled to an air pump in lieu of using said motor; and a release valve, said release valve being mechanically coupled to said aperture in said peripheral wall of said upstanding member, a lever for actuating said release valve, said lever being mounted on said peripheral wall said lever being located generally adjacent to said bottom end of said upstanding member, said lever being a foot pedal.

10. A sheet material work bench apparatus, said apparatus comprising:

a support portion said support portion comprising:

an upstanding member, said upstanding member having a bottom end, a top end, and a peripheral wall extending between said top and bottom ends, said top end being open, said upstanding member having a generally circular shaped cross-section taken transverse to a longitudinal axis of said upstanding member, said upstanding member being hollow, said upstanding member being a post;

a base assembly for supporting said upstanding member, said base assembly comprising four arms, each of said arms having a first end and a second end, each of said first ends being fixedly coupled to said peripheral wall, said first ends being located generally adjacent to said bottom end of said upstanding member, each of said arms radially extending away from said upstanding member, each of said arms being spaced an equal distance from each other, each of said arms being oriented generally perpendicular to said longitudinal axis of said upstanding member;

a brace for bracing said arms of said base assembly, said brace forming a hoop, said hoop having an interior surface, each of said second ends of said arms being integrally coupled to said interior surface of said hoop;

a plurality of wheels, each of said wheels being rotatably coupled to said brace each of said wheels being located generally adjacent to a juncture of one of said arms and said brace, each of said wheels extending away from said top end of said upstanding member;

a plurality of supporting means, each of said supporting means being a leg having a first end and a second end, each of said first ends of said legs being pivotally coupled to said peripheral wall of said upstanding member, each of said first ends of said legs being generally adjacent to said top end of said upstanding member, each of said second ends of said legs having a foot thereon, each of said feet comprising an elastomeric material, each of said legs being telescopic, wherein a length of each of said legs may be selectively adjusted;

a table portion, said table portion comprising:

a plate, said plate having a top side, a bottom side and a peripheral edge, said bottom side having depressions therein, said depressions being located generally adjacent to said peripheral edge, said plate having a generally circular shape;

an annular lip, said annular lip being fixedly coupled to said top side of said plate, said annular lip being generally adjacent to said peripheral edge of said plate, annular lip having a generally rectangular shaped cross section, said annular lip having an inside wall;

a plurality of elongate members for supporting the sheet material above said plate, each of the elongate members having a first end and a second end, each of said first ends of said elongate members being fixedly coupled at a central location of said table portion, each of said elongate members radially extending away from a central portion of said plate, each of said second ends of said elongate members being integrally coupled to said inside wall of said annular lip, each of said elongate members being abutted against said plate, each of said elongate members having a height generally equal to a height of said annular lip, each of said elongate members and said annular lip being covered with an elastomeric material said plurality of elongate members comprising eight elongate members;

a plurality of bores in said plate, each of said bores being generally adjacent to said central location of said table portion;

a coupling means coupling said table portion to said top end of said upstanding member, said coupling means comprising:

a male portion, said male portion being elongate, said male portion having a first end, a second end and a peripheral wall, said peripheral wall having an exterior surface, said male portion being a rod, said rod having a shape adapted to fit in said upstanding member, said rod being generally hollow, said rod being rotatably insertable in said upstanding member, said peripheral wall of said male portion having threads thereon, said threads being generally adjacent to said first end of said male portion, wherein said second end of said male portion is insertable in said upstanding member, said male portion having a generally circular cross-section, said peripheral wall having an annular shoulder formed therein, said annular shoulder being adjacent to an edge of said threads between said threads and said second end of said male portion, said male member being adapted to extend away from said upstanding member, wherein said male portion forms a telescoping arm;

a female portion, said female portion having a distal portion and a proximal portion, said female portion having a peripheral edge being adjacent to said proximal portion, said female portion being generally hollow, said distal portion having an inner surface having threads thereon, said distal portion having a shape adapted for receiving said first end of said male portion, a fastening means releasably securing said peripheral edge of said female portion to said bottom surface of said plate, said female portion being located generally in said central portion off said plate, said fastening means being a screw, said proximal portion generally having a frusto-conical shape;

a first seal for fluidly connecting said male and female portions, said first seal being an annular member, said first seal being abutted against said annular shoulder of said male portion, said first seal being made from an elastomeric material, said first seal being an O-ring;

a second seal for fluidly connecting said male and female portions, said second seal being an annular member, said second seal being abutted against an annular shoulder formed by a juncture of said distal and proximal portions of said female portion, said second seal being made from an elastomeric material, said second seal being an O-ring;

a securing means for selectively securing a position of said coupling means with respect to said upstanding member, said securing means having a knob portion and a rod portion, said rod portion having threads thereon, said rod portion being inserted through a bore in said upstanding member, said bore being generally adjacent to said top end of said upstanding member, said rod being selectively abuttable against said exterior surface of said male portion;

a suction means for drawing air through said bores, said suction means comprising:

an aperture in said peripheral wall of said upstanding member, said aperture being located generally adjacent to said bottom end of said upstanding member, said aperture having a stem fluidly connected thereto, said stem extending away from said upstanding member, said stem being hollow;

a fan propeller to actuate air flow in a direction from said bores in said plate and through said aperture in said peripheral wall of said upstanding member;

a motor for rotating said fan propeller, said motor being mounted to said second end of said male portion, said fan propeller being rotatably coupled to said motor, a bore being in said peripheral wall of said male portion generally adjacent to said fan propeller;

a power supply, said power supply being operationally coupled to said motor;

a hose for drawing air from said upstanding member, said hose having a first end and a second end, said first end of said hose being removably coupled to said stem, wherein said second end of said hose may be fluidly coupled to an air pump in lieu of using said motor;

a release valve, said release valve being mechanically coupled to said aperture in said peripheral wall of said upstanding member, a lever for actuating said release valve, said lever being mounted on said peripheral wall said lever being located generally adjacent to said bottom end of said upstanding member, said lever being a foot pedal;

an actuating means for selectively raising said male portion of said coupling means with respect to said upstanding member, said actuating means comprising:

a jack mounted in said upstanding member, said jack being a pneumatic pump; and a lever for engaging said jack, said lever being mounted in said peripheral wall of said upstanding member, said lever being located generally adjacent to said bottom end of said upstanding member, said lever being a foot pedal.

* * * * *